United States Patent [19]

Knabel et al.

[11] Patent Number: 4,484,761

[45] Date of Patent: Nov. 27, 1984

[54] MAGNETIC RELEASE SYSTEM FOR SAFETY SKI BINDINGS

[75] Inventors: Walter Knabel, Murnau; Gerd Klubitschko; Lorenz Stempfhuber, both of Oberau, all of Fed. Rep. of Germany

[73] Assignee: Marker-Patentverwertungsgesellschaft mbH., Baar, Switzerland

[21] Appl. No.: 397,816

[22] Filed: Jul. 13, 1982

[51] Int. Cl.[3] ..... A63C 9/08

[52] U.S. Cl. ..... 280/612; 292/251.5

[58] Field of Search ..... 280/612, 613; 292/251.5; 335/181, 84

[56] References Cited

U.S. PATENT DOCUMENTS

| | | | |
|---|---|---|---|
| 2,253,252 | 8/1941 | Smith | 292/251.5 |
| 3,001,049 | 9/1961 | Didier | 335/181 X |
| 3,431,002 | 3/1969 | Melgaard | 292/251.5 |
| 3,687,471 | 8/1972 | Sommer | 280/612 |
| 3,774,922 | 11/1973 | Smolka | 280/612 |
| 3,819,199 | 6/1974 | Smolka | 280/612 |
| 3,940,156 | 2/1976 | Marker | 280/612 |
| 4,310,188 | 1/1982 | Aoki | 292/251.5 |

*Primary Examiner*—David M. Mitchell
*Assistant Examiner*—Michael Mar
*Attorney, Agent, or Firm*—Woodling, Krost, Rust and Hochberg

[57] ABSTRACT

A magnetic release system of a safety ski binding having a permanent magnet, a release mechanism, a core disposed between the magnet and release mechanism in which a temporary magnetic field may be induced, an electromagnet coil associated with the core for cancelling or diminishing the magnetic field induced in the core by the magnet, and a spring biasing the release mechanism from a non-actuating to an actuating position.

6 Claims, 1 Drawing Figure

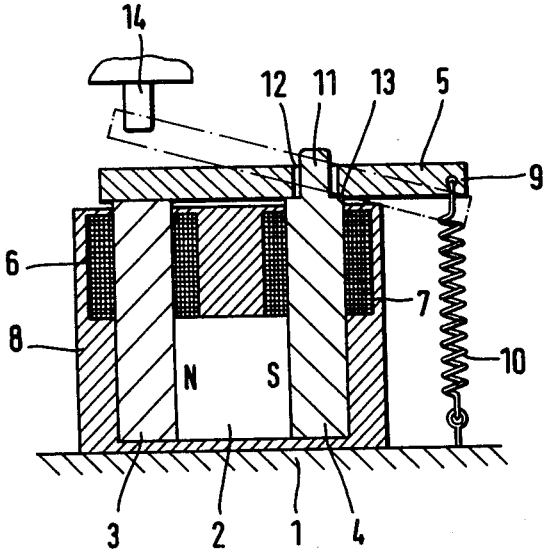
14
12
11
13
5
9
6
7
8
10
N
S
3
2
1
4

MAGNETIC RELEASE SYSTEM FOR SAFETY SKI BINDINGS

BACKGROUND OF THE INVENTION

This invention relates to a magnetic release system for electronic safety ski bindings, which acts as an interface between the electronic component and the physical release component of the binding.

For a skier's optimum safety and convenience, it is important that, while skiing, each ski boot is rigidly fixed with respect to the ski. On the other hand, in the event of an imminent fall it is important that the ski boot is disengaged from the ski to minimize possible injury to the skier. To achieve these goals, a wide variety of safety ski bindings have been developed for releasing a ski boot from a ski when the forces on the ski exceed a predetermined value.

Many ski bindings are entirely mechanical in nature. These mechanical bindings, while useful, tend to be somewhat unpredictable. Although the binding may be set to release when a predetermined force is applied, ice, snow, and dust may interfere with the binding's operation. Also, mechanical bindings often utilize mechanisms that latch the boot to the ski at the heel and toe of the boot, resulting in a binding that is most effective when force is applied at either the heel or the toe of the binding. This is adequate to achieve release when the skier falls either forward or backward, however, with twisting falls or with falls to the side, even though the total force may be sufficient to constitute a danger to the skier, the force on the heel or toe of the binding may be insufficient to achieve release of the ski boot from the ski.

In recent years, electronic ski bindings have been proposed to overcome some of these disadvantages. Some of these bindings include sensors that react not only to the forces acting on the toe and heel portions of the ski boot, but, additionally, the forces acting on the sides of the ski boot, such as occur with twisting falls or falls to the side. These sensors are designed to generate electrical signals when release is appropriate. Examples of such bindings are disclosed in U.S. Pat. No. 4,291,894 issued on Sept. 29, 1981 and incorporated herein by reference.

While these improved ski bindings utilize an electronic system for detecting forces on the ski, the physical release of the ski boot generally involves a mechanical system. Thus, it is necessary to design electronic bindings so that the electrical signals will result in actuation of the mechanical ski boot release. To achieve this goal, an interface between the electronic and mechanical components of the ski binding is necessary. The interface must be activated by the electronic signals and, in turn, actuate the mechanical release system that controls physical release of the ski boot from the ski. U.S. Pat. No. 4,130,296 issued on Dec. 19, 1978 and incorporated herein by reference discloses examples of such ski bindings. The solenoid utilized in that reference is an example of such an interface.

This invention concerns improved magnetic release systems that function as interfaces between the electronic and mechanical components of safety ski bindings. Magnetic release systems are proposed in earlier referenced U.S. Pat No. 4,291,894. According to that reference, a permanent magnet is fixed to a release arm with that unit moveably mounted to the ski binding. The release arm is retained in a latching position by a retainer spring. An electromagnet is fixably attached with respect to the ski binding. The poles of the electromagnet are aligned such that it is attracted to the permanent magnet when the electromagnet is not energized; that is, when the binding is in its latching position.

An electrical signal from the electronic component of the ski binding energizes the electromagnet. This results in pole reversal of the electromagnet and repulsion of the permanent magnet. The permanent magnet, with its attached release arm, then swivels against the force of the retainer spring to an unlatching position, thereby releasing the ski boot.

As discussed in greater detail below, a magnetic release system according to this invention provides several advantages over the above described system. It provides greater efficiency, and consequent lower energy consumption. Additionally, it is well suited for mass production and is designed to greatly reduce the possibility of faulty opening when a ski is jarred.

SUMMARY OF THE INVENTION

This invention provides an improved magnetic release system with practical utility for use in electronic safety ski bindings. Such a release system preferably comprises a permanent magnet with temporary magnetic means in the field of the magnet. A temporary magnetic field may be induced in the temporary magnetic means, which is preferably at least one post constructed of soft iron. A closed magnet system is achieved by use of a release means magnetically attracted to the temporary magnetic means. The release means has associated with it a spring means for biasing the release means from a non-actuating position to an actuating position. In its actuating position, the release means actuates a latch means which brings about boot release. The temporary magnetic means has associated with it a coil which is, in turn, connected to the electronic component of the ski binding, thus creating an electromagnet. The magnetic field induced in the temporary magnetic means by the electromagnet opposes the field induced by the permanent magnet. The magnetic dipole induced in the temporary magnetic means by the permanent magnet is stronger than the force of the spring means associated with the release means; thus when the coil is not energized the release means is retained in its non-actuating position in which it is magnetically attached to the temporary magnetic means.

Boot release is achieved when the electronic component of the ski binding transmits an electrical impulse to the coil. The current surge induces an electromagnetic field in the temporary magnetic means which cancels or weakens the magnetic field induced by the permanent magnet. The spring means then forces movement of the release means in a manner that causes the release means to actuate the physical boot release mechanism.

The release means is the only moveable component in the preferred embodiment of a magnetic release system according to this invention. This provides a small moveable mass relative to the mass of the magnet and the temporary magnetic means, resulting in less likelihood of accidental opening when the ski is jarred. Greater efficiency, with lower energy consumption, is achieved because it is necessary only to weaken the magnetic field induced by the permanent magnet to the point that the spring force is sufficient to move the release means. It is unnecessary to both weaken the magnetic field and counter the force of a retainer spring. Additionally, an edge of the temporary magnetic means may be utilized as a pivot axis for the release means, while a pin associated with the temporary magnetic means acts to retain the release means in its appropriate position. In this manner, construction is simplified, resulting in lower production costs.

BRIEF DESCRIPTION OF THE DRAWING

FIG. 1.—An enlarged vertical cross-section of a magnetic release system according to this invention, illustrating both the actuating and non-actuating positions.

DESCRIPTION OF THE PREFERRED EMBODIMENT

FIG. 1 illustrates a magnetic release system according to the preferred embodiment of this invention. The magnetic release system is mounted on a base 1, which is part of the safety ski binding. The particular part of the ski binding which constitutes base 1 will vary depending on the nature of the boot release latching mechanism utilized in the ski binding.

A magnetic release system according to the preferred embodiment of this invention is shown as comprising a permanent magnet 2 with cores or posts 3, 4 positioned on opposing sides of magnet 2. Magnet 2 induces a temporary magnetic dipole in posts 3, 4; that is, posts 3, 4 do not retain the magnetic dipole if removed from the magnetic influence of magnet 2. While posts 3, 4 are preferably made of soft iron, any solid material in which a temporary magnetic field may be induced is appropriate. Magnet 2 and posts 3, 4 form essentially a U-shaped magnet.

Coils 6, 7 are positioned about posts 3, 4 respectively. These coils are preferably of copper wire or other suitable electrical conducting material and are attached to the electronic component of the ski binding in such a manner that an impulse in the electronic circuit results in current flow through both coils. Coils 6, 7 and posts 3, 4 are mounted in such a manner that when current flows through coils 6, 7 an electromagnetic dipole is induced in posts 3, 4 that opposes the dipole induced by magnet 2; that is the passage of current through coils 6, 7 results in cancelling or diminishing the dipole in posts 3, 4 induced by magnet 2.

A release means is represented by an arm 5. Arm 5 in solid lines illustrates the release arm in its non-actuating position where it is positioned across posts 3, 4, creating a closed magnet system. Arm 5 in broken lines represents the release arm in its actuating position. The release arm is constructed from a material that is influenced by a magnetic field and it is held in its non-actuating position by the magnetic dipole induced in posts 3, 4 by magnet 2. The release arm preferably includes an opening 12 which may be associated with a pin 11 located on post 4 for locating the arm in its desired position during movement between the actuating and non-actuating positions. Arm 5 has an extension 9 extending beyond the edge of post 4. A spring 10 is attached to extension 9 and to base 1 with spring 10 biasing extension 9 in a downwards direction as illustrated in FIG. 1. Spring 10 is preferably a screw tension spring. A casing 8 is provided for holding magnet 2, posts 3, 4 and coils 6, 7 in their relative positions and to provide a convenient housing for ease of mounting.

Actuation of the boot release mechanism results when an electrical impulse is received from the electronic ski component by coils 6, 7. As described above, this impulse induces an electromagnetic field in posts 3, 4 that cancels or diminishes the field induced by magnet 2. When the magnetic influence of magnets is reduced, the force exerted by spring 10 moves the release arm from its non-actuating position to its actuating position. The arm rotates in a clockwise direction about the point of contact between the release arm and an edge 13 of post 4. Opening 12 and pin 11, in conjunction with edge 13, eliminate the need for more expensive and complex guiding means. In the actuating position arm 5 contacts a latch 14 which is associated with the boot release of the ski binding. Contact with latch 14 results in release of the ski boot from the binding.

It is contemplated that the current surge in coils 6, 7 is very brief, wherefore the magnetic dipole induced by the electromagnet is only momentary; thus, arm 5 returns from its actuating to its non-actuating position almost immediately under the influence of the magnetic field induced in posts 3, 4 by magnet 2. Energy consumption is low for the energy source of the ski binding is tapped only during the instants when the forces on the ski exceed the predetermined release values. The energy source may be a suitable self-contained power source, such as a battery. Preferably, the power source for the release system is the same as that for other electrically powered components of the binding.

The release arm 5 is the only moveable component of a magnetic release system according to the preferred embodiment of this invention. The release arm may be quite small in mass and, thus, when coils 6, 7 are not energized it is held firmly against posts 3, 4 by magnetic force. In the absence of an electromagnetic field, the field induced in posts 3, 4 by magnet 2 is significantly stronger than the force exerted by spring 10. A significant mass difference between magnet 2 and posts 3, 4 on the one hand and release arm 5 on the other hand greatly reduces the possibility of faulty release of the arm from its non-actuating to its actuating position when the ski is jarred. Magnet 2 and posts 3, 4 may be quite small without sacrificing this mass difference. Also, a magnetic release system according to this invention is simple and inexpensive to construct.

This invention does not concern the precise nature of boot release mechanisms of the ski binding. Examples of such mechanisms are disclosed in earlier referenced U.S. Pat. No. 4,130,296. A magnetic release system according to this invention may be adapted to many such mechanisms. Similarly, the electronic component of a ski binding in which this invention might be utilized is not described in detail. Most systems generating electrical impulses when release is appropriate may be utilized. Examples of such electronic systems are disclosed in earlier referenced U.S. Pat. No. 4,291,894. Also, although it is contemplated that current surges in the coils for effecting release be very brief, the invention is not restricted to any particular electronics system or to any release current characteristics.

This invention has been described in detail with particular emphasis on the preferred embodiment, but it should be understood that there are variations and modifications within the scope and spirit of this invention.

What is claimed is:

1. A magnetic release system for safety ski bindings for releasing a ski boot holding mechanism from a latching to an unlatching position on receipt of an electrical signal, said magnetic release system comprising;

a permanent magnet;

release means capable of movement relative to said permanent magnet between an actuating and a non-actuating position for actuating a ski boot holding mechanism from a latching to an unlatching position;

temporary magnetic means including at least one core fixedly secured to said permanent magnet for magnetically retaining said release means in said non-actuating position; wherein said permanent magnet induces a temporary magnetic field in said temporary magnetic means;

electro-magnetic means fixedly secured to said temporary magnetic means for inducing a magnetic field in said temporary magnetic means on receipt of an electrical impulse; said magnetic field induced by said electro-magnet opposing said magnetic field induced by said permanent magnet; said magnetic field induced by said electro-magnet in said temporary magnetic means thereby diminishing said magnetic field induced by said permanent magnet in said temporary magnetic means;

spring means, biasing said release means from said non-actuating to said actuating position, for forcing said release means from said non-actuating to said actuating position when said electro-magnetic means diminishes the magnetic field induced by said permanent magnet in said temporary magnetic means, and guide means for guiding said release means from said non-actuating to said actuating position, said guide means including an opening in said release means, a pin on said core for entering said opening, and a pivot axis about which said release means is pivotally movable from its non-actuating to its actuating position, wherein said release means reciprocates relative to said pin.

2. A magnetic release system according to claim 1, wherein said electromagnetic means comprises said core and a coil of electrical conducting material associated with said core; said coil inducing an electromagnetic field in said core when said coil receives an electrical impulse.

3. A magnetic release system according to claim 1 wherein said pivot axis comprises an edge of said core.

4. A magnetic release system according to claim 1, wherein said release means comprises a release arm.

5. A magnetic release system according to claim 4 wherein said spring means comprises a screw tension spring biasing said release arm from said non-actuating to said actuating position.

6. A magnetic release system according to claim 4 wherein the mass of said release arm is less than the combined masses of said permanent magnet and said electromagnetic means.

* * * * *